US005520090A

United States Patent [19]

Eagle

[11] Patent Number: 5,520,090

[45] Date of Patent: May 28, 1996

[54] DRUMMING PRACTICE SET

[76] Inventor: David Eagle, 2042 High Tower Dr., Los Angeles, Calif. 90069

[21] Appl. No.: 255,259

[22] Filed: Jun. 7, 1994

[51] Int. Cl.[6] ..... G10D 13/02

[52] U.S. Cl. ..... 84/411 P; 84/422.4

[58] Field of Search ..... 84/411 P, 422.4

[56] References Cited

U.S. PATENT DOCUMENTS 4,179,974 12/1979 Trankle ..... 84/411 P 4,488,470 12/1984 Larrain ..... 84/422.4

*Primary Examiner*—Patrick J. Stanzione

*Attorney, Agent, or Firm*—Albert O. Cota

[57] ABSTRACT

A drumming practice set (10) consisting of a combination drumstick practice pad (12) and a pair of practice drumsticks (40). When used together, a percussionist in pursuit of evenness and control, can achieve optimum results in the shortest time. The drumstick pad (12) consists of a lower resilient section (14) that attaches to an upper drumstick striking pad (22) that includes a set of five drumstick striking patterns (28). The practice drumsticks (40) are larger and heavier than conventional drumsticks and include an oversized bead (54). The practice drumsticks (40) feature a set of at least three, spaced, circular finger-placement marks (60) located around the drumstick circumference. When the thumb is placed over the front ring, the drumstick will provide maximum bounce; when placed over the back ring, to change the fulcrum, a maximum power strike is produced. The bead (54) is painted in a contrasting color to the remaining section of the drumstick. These contrasting colors help a percussionist to easily observe drumstick strikes and movements relative to the prevailing color scheme of the practicing environment.

23 Claims, 3 Drawing Sheets

DRUMMING PRACTICE SET

TECHNICAL FIELD

The invention pertains to the general field of practicing sets for percussive instruments and more particularly to a drumming practice set that includes an easily storable drumstick practice pad that is used with oversized and calibrated practice drumsticks.

BACKGROUND ART

Percussionists and especially drummers, even those with extensive experience, require practice sessions to maintain their skill level. Practicing with a set of drums is ideally the preferred practice method. However, the acquisition of a drum set is in many cases not practical due to either a lack of a drum set or a suitable location and/or space to set-up the drum set.

In the prior art, there are several smaller primarily electronic drum pad sets, that can serve as drum practice sets. However, these units require that they be activated by a power source which at times, can be a problem. Also, these powered units include operational controls that must be set and, they are typically not sized or weighted to be easily carried.

In contract, the instant invention has no controls, is sized and weighted to be easily carried and can used at anytime, and in any place without the need of a power source.

A search of the prior art did not disclose any patents that read directly on the claims of the instant invention however, the following U.S. patents were considered related:

| U.S. PAT. NO. | INVENTOR | ISSUED |
|---|---|---|
| Des. 319,249 | Aluisi | 20 August 1991 |
| 4,479,412 | Klynas | 30 October 1984 |
| 4,719,836 | Baumgart | 19 January 1988 |
| 4,488,470 | Larrain | 18 December 1984 |
| 3,137,194 | Simpson, Jr. | 16 June 1964 |

The Des. 319,249 Aluisi patent discloses an electronic drum pad set. The set includes a circular base having an upwardly extending edge. On the center of the platform is located a center percussion pad. Around the center pad are evenly distributed six additional percussion pads that allow a drummer to practice his drumstick striking skills.

The U.S. Pat. No. 4,479,412 Klynas patent discloses an electronic percussion synthesizer. The synthesizer has a base unit to which are attached, at each corner a pressure transducer. Each transducer represents a different percussive musical instrument and is responsive to an external striking force such as from a drumstick.

The U.S. Pat. No. 4,719,836 Baumgart patent discloses a drumstick for the left hand that has three recesses in the peripheral surface. One of the recesses is for a portion of the palm in the region of the short flexor of the thumb, another for the ring finger, and the third for the middle finger. The drumstick for the right hand has similar recesses. These recesses enable the user to repeatedly hold the drumstick in a preset position to beat a drum.

The U.S. Pat. No. 4,488,470 Larrain patent discloses a drumstick having serially disposed length portions of reducing diameter from the butt end to the tip end of the drumstick. The handle end of the drumstick has a series of surface interruptions. The interruptions are designed to facilitate handling of the drumstick without slippage.

The U.S. Pat. No. 3,137,194 Simpson Jr. patent disclosed a drumstick design that includes a detachable pair of rings which are positioned on each drumstick at positions preferred by a user. The rings may be spaced closer or wider apart, depending upon the size of the user's hand. The rings are particularly useful for beginners as an aid to learning the proper position for holding the drumsticks in proper balance. However, professional drummers can also use the rings to provide a continuous comfortable grip that is subconsciously maintained during periods of playing.

For background purposes and as indicative of the art to which the invention relates, reference may be made to the following remaining patents found in the search:

| U.S. PAT. NO. | INVENTOR | ISSUED |
|---|---|---|
| Des. 328,915 | Sato | 25 August 1992 |
| 4,779,507 | Shimoda et al | 25 October 1988 |
| 4,476,768 | Willis | 16 October 1984 |
| 3,866,508 | Huslig | 18 February 1975 |

DISCLOSURE OF THE INVENTION

The drumming practice set was designed to provide a percussionist with a means to practice his drumming skills at any time and at any place with the greatest degree of efficiency. The set is comprised of a drumstick practice pad and a pair of practice drumsticks.

The drumstick practice pad consists of a lower resilient section and an upper drumstick striking pad. The lower resilient section is preferably constructed of neoprene and has a rectangular shape with an upper surface and a lower surface. The upper drumstick striking pad is preferably constructed of a transparent material such as LEXAN®. The pad has a similar rectangular shape as that of the lower resilient section and has an upper surface and a lower surface. On its lower surface, at each corner and on its center, is imprinted a circular drumstick striking pattern. To complete the drumstick practice pad, the upper surface of the lower resilient section is attached by an adhesive, to the lower surface of the upper drumstick striking pad.

The practice drumsticks used with the drumstick practice pad are heavier and larger than conventional drumsticks. Each of the inventive drumsticks includes a back section that extends from the butt end of the drumstick for substantially two-thirds the overall longitudinal length of the drumstick which is at least 16.00 inches (40.64 cm). The back section has a diameter of at least 0.6875 inches (1.746 cm). Extending inward from the back section is an integral tapered shoulder. The shoulder extends from the inward end of the back section to the remaining one-third longitudinal length to the tip end of the neck of the drumstick. The tip end diameter is at least 0.3125 inches (0.794 cm). To the tip end of the drumstick is integrally attached a bead that has a diameter of at least 0.75 inches (1.905 cm).

Substantially centered on the back section of the drumstick are at least three spaced apart finger-placement marks. The marks are preferably comprised of five circular rings that are placed around the drumstick circumference. The front ring is placed so that when the thumb is placed over the ring, the drumstick provides a maximum bounce. When the thumb is placed over the back ring, the drumstick produces maximum power.

The darker bead allows a percussionist to see the relative position of the two drumstick beads and consequently the position of the drumsticks. This observance leads to quickly achieving evenness of sound and control. Also, the contrasting color of the drumstick to the bead and, to the prevailing color scheme of the practicing environment, allows a percussionist to glance at the drumsticks to track their vertical motion and to correct a deviation from the vertical before it becomes a bad habit.

The practice pad includes a set of striking patterns that simulate the multiple playing surfaces of a conventional drum set. The drumsticks have carefully designed markings and color schemes to promote the greatest desired results in the shortest time period.

In addition to the above primary objects of the invention, it is also an object of the invention to provide a drumming practice set that:

can be used by both professional, amateur and student percussionists, requires no maintenance, can be made in various color combinations and is cost effective from both a manufacturers and consumers points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
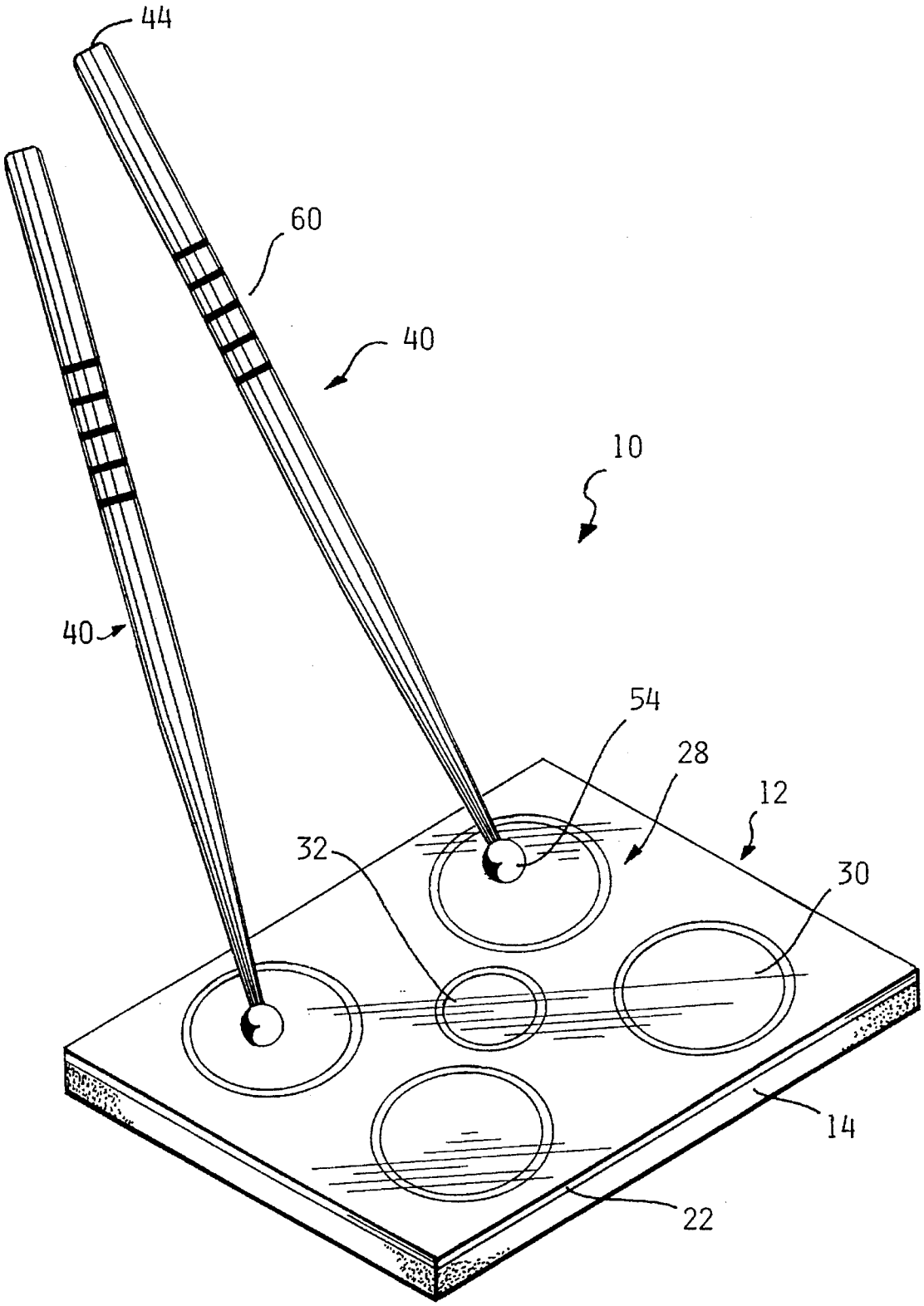
FIG. 1 is a perspective view of a drumstick practice pad that includes on its upper surface a set of drumstick striking patterns, and a pair of practice drumsticks.

The best mode for carrying out the invention is presented in terms of a preferred embodiment that allows a drummer to practice various rhythmic beats without a set of drums. The preferred embodiment of the drumming practice set 10 as shown in FIGS. 1–11, is comprised of two major elements: a drumstick practice pad 12 and a pair of practice drumsticks 40.

The practice pad 12 as shown in FIGS. 1–5 is comprised of a lower resilient section 14 and an upper drumstick striking pad 22. The section 14 has an upper surface 16 and a lower surface 18, likewise the pad 22 has an upper surface 24 and a lower surface 26.

Figure 3:
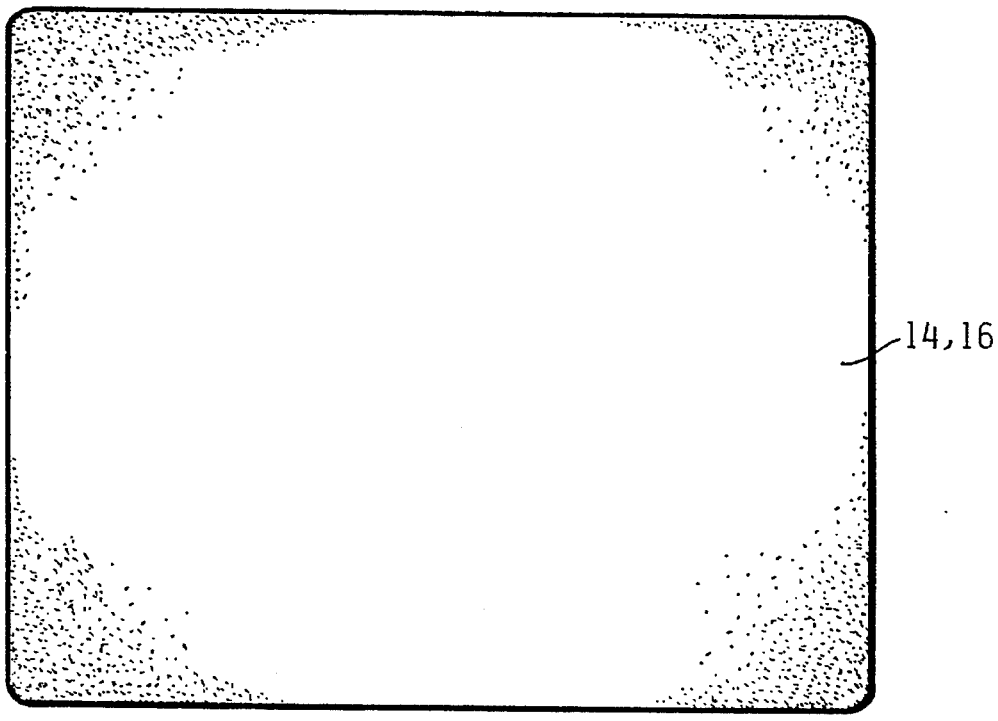
FIG. 3 is a bottom plan view of the drumstick striking pad.
Figure 4:
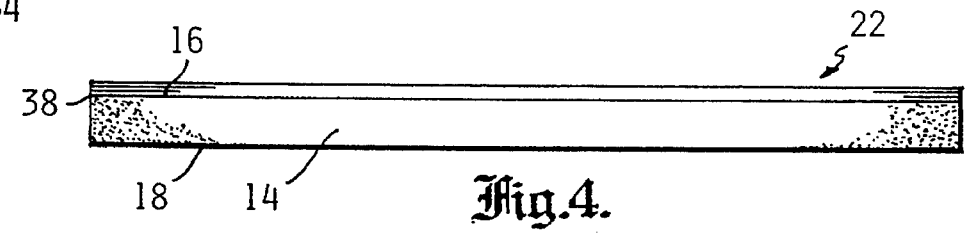
FIG. 4 is an elevational front and back side view of ting drumstick striking pad showing the lower resilient section attached to the upper drumstick striking pad.
Figure 5:
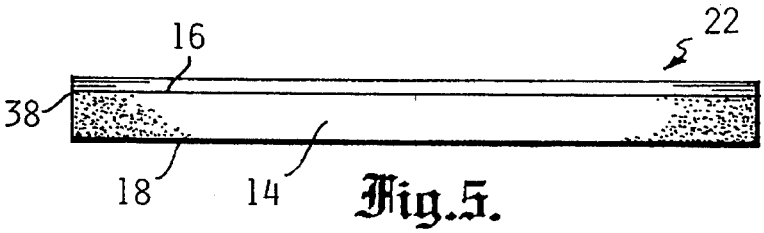
FIG. 5 is an elevational right and left side view thereof.
Figure 7:
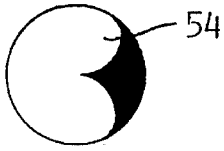
FIG. 7 is a front view of the practice drumstick.
Figure 8:
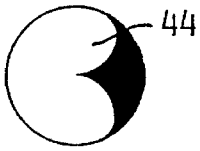
FIG. 8 is a back view of the practice drumstick.

The lower resilient section 14 as shown in FIGS. 3, 4 and 5 is constructed of neoprene. However, any resilient material such as soft plastic or a rubber compound can be used. Preferably, the lower resilient section 14 is rectangular in shape, with a length of 9.5 inches (24.13 cm), a width of 7.5 inches (19.05 cm) and a thickness between 0.125 inches (0.318 cm) and 0.25 inches (0.635).

Figure 2:
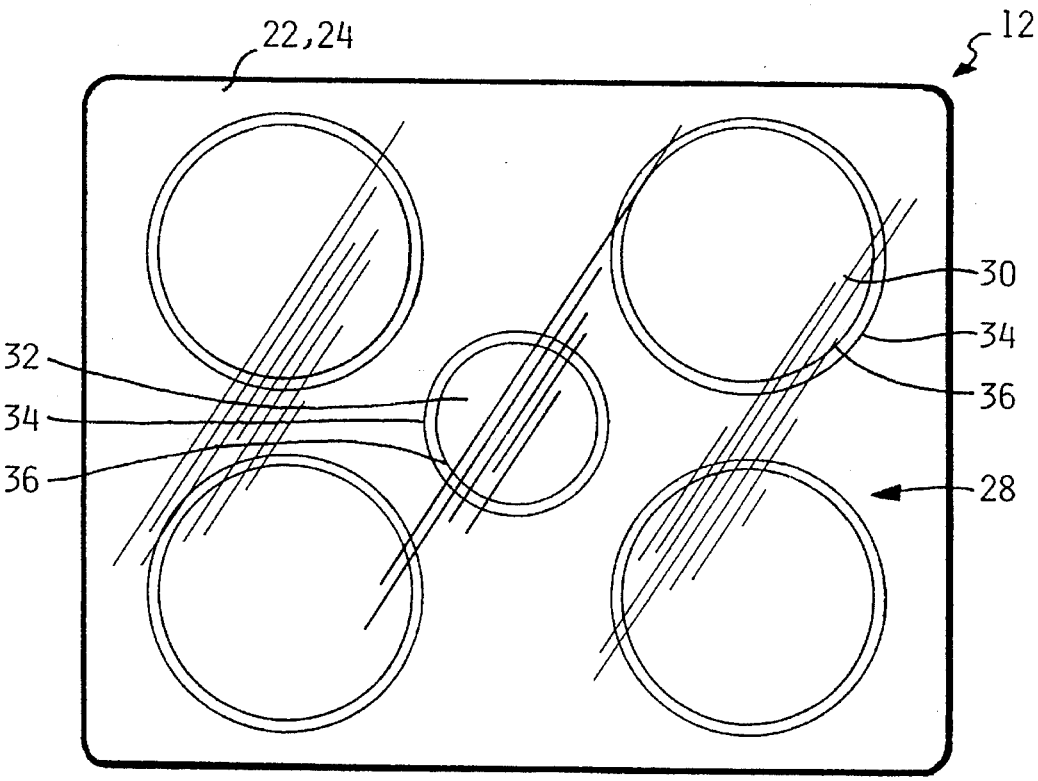
FIG. 2 is a top plan view of the drumstick striking pad showing a set of circular striking patterns arranged in a preferred sequence.

The upper drumstick striking pad 22 as shown in FIGS. 2, 4 and 5 has an upper surface 24, a lower surface 26 and is constructed of a transparent or translucent material, preferably of a transparent plastic such as LEXAN®. The upper drumstick striking pad 22 is also rectangular in shape having similar overall dimensions as those of the lower resilient section 14.

To allow the drumstick practice pad 12 to function as a drum practicing means, the upped drumstick striking pad has imprinted on the lower surface of the transparent material a set of drumstick striking patterns 28. The patterns 28 as shown best in FIG. 2, preferably have a circular shape with larger circles 30 imprinted on each corner and a smaller circle imprinted in the center. Although a circular striking pattern is preferred, square, triangular, diamond, star or any other geometric shape can be utilized to function as a striking pattern. To improve visibility and to add aesthetics to the design, the striking pattern as shown in FIG. 2, is imprinted with an outer stripe 34 and an inner stripe 36. The stripes have contrasting colors such as black and red, blue and yellow and the like to further aid in allowing a practicing person to view and select the striking pattern.

To complete the drumstick practice pad 12, the upper surface 16 of the lower resilient section 14 is attached to the lower surface 24 of the upper drumstick striking pad 22 by an attachment means 38. The attachment means preferably consists of an adhesive as shown in FIGS. 4 and 5. The overall size and thickness of the drumstick practice pad 12 allows it to be easily stored and carried. Therefore, the pad 12 can be used at any time and at any place to commence a drumming practice session.

Figure 6:
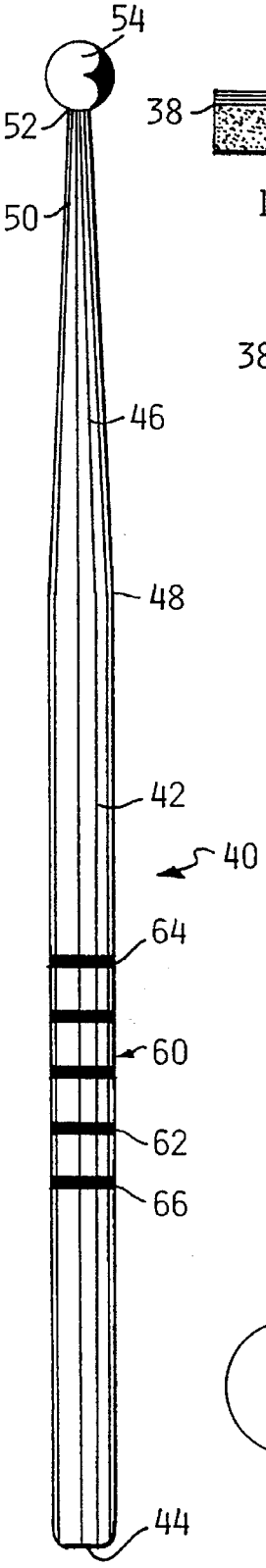
FIG. 6 is a side elevational view of the practice drumstick showing a back section that has a butt end, a tapered shoulder having an integral inward end that extends into a neck that terminates at a tip end, a bead attached to the tip end, and a set of five circular finger placement marks.

The second element that comprises the drumming practice set are the pair of practice drumsticks 40 as shown in FIGS. 1, 6–11. Each drumstick consists of a back section 42, having a butt end 44, a tapered shoulder 46 having an integral inward end 48 that extends into a neck 50 that terminates at a tip end 52. To the tip end 52 is integrally attached a front bead 54. The overall practice drumstick 40 is shown in FIG. 6 with the front and back of the drumstick shown respectively in FIGS. 7 and 8. The practice drumstick is preferably made of maple because of its vibrational characteristics. However other hardwoods or a plastic material such as a fiber composite may also be used.

Figure 9:
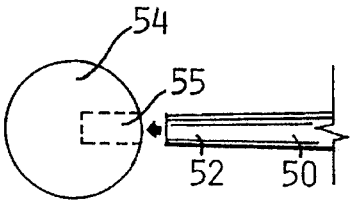
FIG. 9 is a side view showing a method that may be used to attach the bead to the tip end of the practice drumstick.

The drumstick's back section 42 extends from the butt end 44 for substantially two-thirds the overall longitudinal length of the drumstick which is at least 16.00 inches (40.64 cm). The tapered shoulder 46 extends integrally from the inward end 48 of the back section 42 to the remaining one-third longitudinal length to the tip end 52 of the neck 50 as shown in FIG. 6. To the tip end of the drumstick is attached a bead 54. Typically, the bead is machined to be an integral part of the drumstick. However, in some instance, a bead attachment means as shown in FIG. 9, may be used. This means consists of boring into the bead a cavity 55 that is sized to frictionally fit over the tip end 52 of the practice drumstick 40. The diameter of the oversized bead 54 when used with the inventive drumstick practice pad 12, produces a warmer, fuller sound that more closely simulates an actual drum set.

The drumstick's back section 42 has a diameter of at least 0.6875 inches (1.746 cm), and the tapering shoulder 46 has a front tip diameter of at least 0.3125 inches (0.794 cm). The bead 54 has a diameter of at least 0.75 inches (1.905 cm).

The balance point of the drumstick is located below the longitudinal midpoint of the drumstick and the first ring 64 is located below the balance point.

To help the practicing drummer achieve an optimum practice session, the bead 54 is painted in a contrasting color from that of the remaining sections of the practice drumstick 40. In this color scheme the bead 54 is painted in a darker color, such as black or blue, and the remaining drumstick section is painted red or green. The darker bead 54 allows a percussionist to see the relative position of the two drumstick beads and consequently the position of the drumsticks 40. This observance leads to improved ability in achieving evenness of sound and control. Also, the contrasting color of the drumstick 40 with the bead 54 and, to the prevailing color scheme of the practicing environment allows a percussionist to glance at the drumsticks to track their vertical motion and to correct a deviation from the vertical before it becomes a bad habit.

The drumming practice set 10 allows a drummer to achieve maximum efficiency from a practice session which includes: the relative placement of the two drumsticks with respect to a particular exercise pattern and evenness and control of the drumstick strokes. To achieve this efficiency, the practice drumsticks 40 include at least three and preferably five spaced apart finger-placement marks 60 that ape substantially centered on the drumstick's back section 42. Preferably, the finger placement marks 60 are comprised of circular rings 62 that are placed around the circumference of the drumstick 40 as shown in FIGS. 1 and 6. The front ring 64 is located so that when the thumb is placed over the front ring, the practice drumstick 40 provides a maximum bounce. Likewise, when the thumb is placed on the back ring 66, the drumstick produces maximum power.

Figure 10:
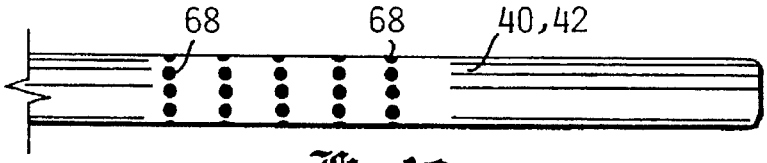
FIG. 10 is a side view showing a series of dots that may be used for finger placement marks.

Although the circular rings 62 are preferred for the finger placement marks, a series of dots 68 or other symbols may be used in lieu of the rings. The dots would likewise be located around the drumstick's diameter as shown in FIG. 10.

Figure 11:
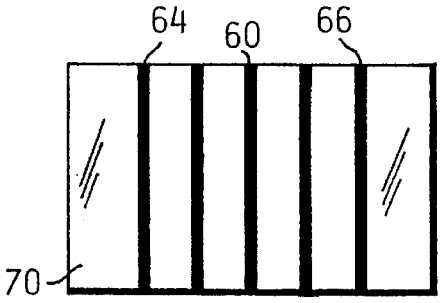
FIG. 11 is a plan view of a transparent material that includes a set of circular finger placement marks. The material includes an adhesive that allows it to be attached around the circumference of the practice drumstick.

The circular rings 62 or dots 68 may be printed directly on the surface of the practice drumstick 40. However, the preferred method is to print the finger placement marks 60 on the backside of a transparent material 70 as shown in FIG. 11. The transparent material has an adhesive backside surface that is applied after the finger placement marks are printed. When the transparent material 70 is wrapped around and attached to the circumference of the practice drumstick 40, the finger placement marks 60 can be viewed and are protected from surface contact.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

I claim:

1. A drumming practice set comprising:

a) a drumstick practice pad comprising, (1) a lower resilient section having an upper surface and a lower surface, (2) an upper drumstick striking pad having an upper surface and a lower surface with the upper surface having a plurality of drumstick striking patterns, and, (3) means for attaching the upper surface of said lower resilient section to the lower surface of said upper drumstick striking pad, and b) a pair of practice drumsticks where each drumstick comprises:

(1) a back section having a butt end and an inward end, where the back section extends from the butt end for substantially two-thirds the overall longitudinal length of said drumstick, (2) a tapered shoulder that extends integrally, for the remaining one-third longitudinal length of said drumstick, from the inward end of the back section to a neck that terminates at a tip end, (3) a bead integrally attached to the tip end of said drumstick, and (4) at least three spaced apart finger-placement marks that are substantially centered on the back section of said drumstick.

2. The set as specified in claim 1 wherein said drumstick practice pad has a rectangular shape.

3. The set as specified in claim 2 wherein said rectangular drumstick practice pad has a length of 9.5 inches (24.13 cm), a width of 7.5 inches (19.05 cm), and a thickness between 0.125 inches (0.318 cm) and 0.25 inches (0.635 cm).

4. The set as specified in claim 3 wherein the upper drumstick striking pad of said drumstick practice pad is constructed of a transparent material having an upper surface and a lower surface, where on its lower surface, on each corner and on its center, is imprinted said drumstick striking patterns.

5. The set as specified in claim 4 wherein said drumstick striking patterns have a geometric shape.

6. The set as specified in claim 4 wherein said geometric shape of said drumstick striking pattern consists of a circle.

7. The set as specified in claim 6 wherein said drumstick striking patterns are comprised of an outer stripe and an inner stripe having a contrasting color.

8. The set as specified in claim 4 wherein the transparent material of said upper striking pad is constructed of LEXAN®.

9. The set as specified in claim 1 wherein the lower resilient section of said drumstick practice pad is constructed of neoprene.

10. The set as specified in claim 1 wherein said means for attaching the upper surface of said lower resilient section to the lower surface of said upper drumstick striking pad is by an adhesive.

11. The set as specified in claim 1 wherein said practice drumstick is constructed of wood.

12. The set as specified in claim 1 wherein said practice drumstick is constructed of a plastic material.

13. The set as specified in claim 1 wherein the back section of said practice drumstick has a diameter of at least 0.6875 inches (1.746 cm), the tapering shoulder has a tip end diameter of at least 0.3125 inches (0.794 cm) said bead has a diameter of at least 0.75 inches (1.905 cm), and said practice drumstick has an overall length of at least 16.00 inches (40.64 cm).

14. The set as specified in claim 1 wherein said finger-placement marks are comprised of circular rings placed around the drumstick circumference, where the front ring is placed so that when the thumb is placed over the front ring, said practice drumstick provides a maximum bounce and when the thumb is placed over the back ring, the drumstick produces maximum power.

15. The set as specified in claim 14 wherein the balance point of said drumstick is located below the longitudinal midpoint of said drumstick and the front ring is located below the balance point.

16. The set as specified in claim 15 wherein said finger placement marks are printed on the backside of a transparent material having an adhesive backside surface, where when said material is wrapped around and attached to said practice drumstick, said finger placement marks to be viewed and protected from surface contact.

17. The set as specified in claim 1 wherein said finger-placement marks are comprised of a series of dots located around the drumstick circumference, where the front dots are placed so that when the thumb is placed over the front dots, said practice drumstick provides a maximum bounce and when the thumb is placed over the back dots, the drumstick produces maximum power.

18. The set as specified in claim 1 wherein said finger placement marks are printed directly on the surface of said drumstick.

19. The set as specified in claim 1 wherein the back section and continuing tapering shoulder of said drumstick is painted in a contrasting color from that of said bead.

20. The set as specified in claim 19 wherein the colors of said drumstick and bead are also in contrast with the prevailing color scheme of the practicing environment where the drumming practice session is taking place.

21. A drumstick practice pad comprising:

a) lower resilient section constructed of neoprene and having a rectangular shape with an upper surface and a lower surface, b) an upper drumstick striking pad constructed of transparent LEXAN® and having a similar rectangular shape as that of said lower resilient section with an upper surface and a lower surface, where on its lower surface, on each corner and on its center, is imprinted a circular drumstick striking pattern, and c) means for attaching the upper surface of said lower resilient section to the lower surface of said upper drumstick striking pad.

22. A practice drumstick comprising:

a) a back section having a butt end and an inward end, where the back section extends from the butt end for substantially length of said drumstick and has a diameter of at least 0.6875 inches (1.746 cm), b) a tapered shoulder that extends integrally, for the remaining one-third longitudinal length of said drumstick, from the inward end of the back section to a neck that terminates at a tip end, where the tip end has a diameter of at least 0.3125 inches (0.794 cm) and said drumstick has an overall length of at least 16.00 inches (40.64 cm), c) a bead integrally attached to the tip end of said drumstick, where said bead has a diameter of at least 0.75 inches (1.905 cm), d) at least three spaced apart finger-placement marks that are substantially centered on the back section of said drumstick, where said finger placement marks are comprised of circular rings placed around the drumstick circumference, where the front ring is placed so that when the thumb is placed over the ring, said drumstick provides a maximum bounce and when the thumb is placed over the back ring, the drumstick produces maximum power, and e) a practice drumstick color scheme in which the drumstick bead is painted in a contrasting color from that of the remaining sections of the drumstick.

23. The practice drumstick as specified in claim 22 wherein said finger-placement marks are printed on the backside of a transparent material having an adhesive backside surface, where when said material is wrapped around and attached to said practice drumstick, said finger-placement marks can be viewed and are protected from surface contact.

* * * * *